US012516578B2

(12) United States Patent
Slack

(10) Patent No.: US 12,516,578 B2
(45) Date of Patent: Jan. 6, 2026

(54) BAIL EXTENSION SYSTEM

(71) Applicant: NOETIC TECHNOLOGIES INC., Edmonton (CA)

(72) Inventor: Maurice William Slack, Edmonton (CA)

(73) Assignee: NOETIC TECHNOLOGIES INC., Edmonton (CA)

( * ) Notice: Subject to any disclaimer, the term of this patent is extended or adjusted under 35 U.S.C. 154(b) by 0 days.

(21) Appl. No.: 18/851,673

(22) PCT Filed: Apr. 10, 2023

(86) PCT No.: PCT/CA2023/000007
§ 371 (c)(1),
(2) Date: Sep. 26, 2024

(87) PCT Pub. No.: WO2023/193084
PCT Pub. Date: Oct. 12, 2023

(65) Prior Publication Data

US 2025/0207468 A1 Jun. 26, 2025

Related U.S. Application Data

(60) Provisional application No. 63/329,231, filed on Apr. 8, 2022.

(51) Int. Cl.
*E21B 19/06* (2006.01)

(52) U.S. Cl.
CPC ..... *E21B 19/06* (2013.01)

(58) Field of Classification Search
CPC ..... E21B 19/06
See application file for complete search history.

(56) References Cited

U.S. PATENT DOCUMENTS 730,233 A 6/1903 Chickering et al.
1,086,772 A * 2/1914 Hoxie ..... B22D 41/06
294/68.27

(Continued)

FOREIGN PATENT DOCUMENTS

WO 2019204897 A1 10/2019

OTHER PUBLICATIONS

International Search Report re PCT/CA2023/000007, completed by the ISA/CA on Aug. 14, 2023, and mailed by the ISA/CA on Aug. 15, 2023.

(Continued)

*Primary Examiner* — Steven A Macdonald
(74) *Attorney, Agent, or Firm* — Donald V. Tomkins

(57) ABSTRACT

Bail extensions for drilling rig bails can be pivoted relative to the bails in a direction away from the well centerline, but remain collinear with the bails when the bails are deflected away from the well centerline by link tilts. The extensions are mounted to frames mounted to the bails' lower eyes, such that the bail extensions maintain a constant angular orientation relative to the frames. The frames include reaction plates that exert reaction forces on the bails when the bails are deflected from vertical by the link tilts, thus maintaining the bail extensions collinear with the bails. The bail extensions may be length-adjustable. An adjustable extension yoke may be mounted between the frames to adjust and maintain a selected spacing therebetween. An adjustable casing guide may be mounted between the bail extensions to facilitate stabbing of a casing joint carried by a pipe elevator suspended from the bail extensions.

9 Claims, 14 Drawing Sheets

(56) References Cited

U.S. PATENT DOCUMENTS

| | | | | |
|---|---|---|---|---|
| 2,313,243 | A | 3/1943 | Johnson | |
| 2,616,747 | A * | 11/1952 | Ratigan | E21B 19/06 294/102.2 |
| 4,793,422 | A | 12/1988 | Krasnov | |
| 4,800,968 | A | 1/1989 | Shaw et al. | |
| 6,520,709 | B1 * | 2/2003 | Mosing | B66C 1/66 403/300 |
| 6,679,333 | B2 | 1/2004 | York et al. | |
| D543,833 | S | 6/2007 | Folk et al. | |
| 7,296,630 | B2 | 11/2007 | Severin et al. | |
| 7,350,587 | B2 | 4/2008 | Springett et al. | |
| 7,726,394 | B2 | 6/2010 | Angelle et al. | |
| 8,887,801 | B2 | 11/2014 | Angelle et al. | |
| 9,279,297 | B2 | 3/2016 | Angelle et al. | |
| D768,471 | S * | 10/2016 | Marquez | D8/382 |
| 9,556,690 | B1 | 1/2017 | Marquez | |
| 9,915,108 | B1 * | 3/2018 | Keast | F15B 11/17 |
| 10,479,644 | B2 | 11/2019 | Vierke | |
| 10,519,728 | B2 | 12/2019 | Sopracolle | |
| 10,641,305 | B2 | 5/2020 | Stoldt | |
| 10,801,276 | B2 | 10/2020 | Bergeron et al. | |
| 2006/0000600 | A1 * | 1/2006 | Pietras | E21B 19/24 166/77.52 |
| 2006/0191690 | A1 * | 8/2006 | Severin | E21B 3/022 166/380 |
| 2010/0080670 | A1 * | 4/2010 | Henderson | E21B 19/06 414/22.68 |
| 2012/0152619 | A1 * | 6/2012 | Hofste | E21B 3/022 175/48 |
| 2013/0011221 | A1 * | 1/2013 | Mcintosh | E21B 19/06 414/800 |
| 2013/0105168 | A1 * | 5/2013 | Overland | E21B 19/06 166/75.11 |
| 2014/0090856 | A1 * | 4/2014 | Pratt | E21B 19/06 166/380 |
| 2014/0110135 | A1 | 4/2014 | Meaux | |
| 2015/0337608 | A1 * | 11/2015 | Lovell | E21B 19/02 166/77.51 |
| 2016/0115744 | A1 * | 4/2016 | Hayes | E21B 19/06 166/85.1 |
| 2017/0314330 | A1 | 11/2017 | Jantzen | |
| 2017/0370165 | A1 * | 12/2017 | Lutgring | E21B 19/087 |
| 2020/0056649 | A1 * | 2/2020 | Slack | F16C 7/06 |
| 2024/0068307 | A1 * | 2/2024 | Amezaga | E21B 19/16 |
| 2025/0154834 | A1 * | 5/2025 | Hoffos | E21B 19/06 |
| 2025/0207468 | A1 * | 6/2025 | Slack | E21B 19/06 |

OTHER PUBLICATIONS

Written Opinion of the International Searching Authority re PCT/CA2023/000007, completed by the ISA/CA on Aug. 14, 2023, and mailed by the ISA/CA on Aug. 15, 2023.

Amendments to PCT/CA2023/000007 under PCT Article 34, filed Feb. 8, 2024.

Formal Response to Written Opinion of the International Searching Authority re PCT/CA2023/000007, filed Feb. 8, 2024.

International Preliminary Report on Patentability—Chapter II re PCT/CA2023/000007, issued by the IPEA/CA on Jun. 28, 2024.

* cited by examiner

BAIL EXTENSION SYSTEM

FIELD

The present disclosure relates in general to bails used on drilling rigs to handle tubular joints when making up or breaking out a tubular string, and relates in particular but not exclusively to bail extensions for increasing the reach of the bails on top-drive-equipped drilling rigs.

BACKGROUND

Tubular strings used in the construction of petroleum wells (e.g., drill strings and casing strings) are made up from pipe segments (or "joints") connected end-to-end by means of threaded connections. Conventional methods for installing tubular strings require two independent systems—namely, a power tong system used in coordination with the hoisting system of a drilling rig. Power tongs are used for rotating a tubular joint in a first direction to form a threaded connection to the upper end of a tubular string being assembled and installed into a wellbore (i.e., "make-up" operations), and for rotating a tubular joint in the opposite direction to disconnect it from its threaded connection to the upper end of a tubular string being disassembled and pulled out of a wellbore (i.e., "break-out" operations). The drilling rig's hoisting system is used for hoisting and lowering individual pipe joints and the tubular string.

Modern drilling rigs commonly incorporate a top drive to rotate tubular joints during make-up and break-out operations and to perform other drilling operations, instead of a conventional "rotary table". Top-drive-equipped drilling rigs have enabled a new method for installing casing in a wellbore (i.e., casing running operations) using tools commonly known as casing running tools (or "CRTs"). These tools are adapted to be mounted to and suspended from the top drive quill, to grip the upper end of a tubular casing joint, and to provide a seal between the bore of the gripped casing joint and the bore of the top drive quill. In coordination with the top drive, CRTs support both make-up and break-out operations as well as hoisting and lowering of the casing string, thereby eliminating the need to use power tongs for casing make-up and break-out operations.

The top drive provides two load paths capable of supporting the weight of a tubular string. During drilling operations (including "drilling with casing" operations), the weight of the tubular drill string is carried by the top drive via the top drive quill, which is typically designed to support the full weight of the drill string. During make-up and break-out operations, the weight of individual joints being added to or removed from a tubular string is transferred to the top drive via a pair of lugs (commonly referred to as "ears") provided on laterally opposite sides of the top drive, in conjunction with a conventional pipe elevator fitted with a pair of links (commonly referred to as "bails"). Each bail comprises a rod having a loop (commonly referred to as an "eye") at each end, with one eye configured for swiveling engagement with one of the ears on the top drive, and with the other eye configured for swiveling engagement with the pipe elevator. Link tilts (typically comprising hydraulic cylinders) installed between the top drive and the bails move the bails between a vertical orientation in which the elevator is positioned above the well's centerline, and an inclined (or "tilted") orientation in which the elevator is positioned laterally away from the well centerline toward a drilling rig's "V-door" (a well-understood term in the art referring to an opening through which tubular joints may enter or exit the drilling rig structure) to facilitate handling of tubulars. Thus configured, the top drive can be used to position a tubular joint carried by the elevator for connection to a tubular string during make-up operations, or to remove a joint from the string during break-out operations.

The use of CRTs allows the top drive quill to carry the full weight of a casing string during casing running operations. The bails and elevator do not need to carry the full weight of the casing string as in conventional operations without CRTs. However, the bails and elevator still serve the important function of hoisting casing joints from the V-door at the rig floor into the drilling rig structure for assembly into the casing string. The top drive is typically equipped with comparatively short bails that are designed for drilling operations (i.e., the lower ends of the bails are just below the top drive near the top drive quill). The mounting of a CRT and associated accessories onto the top drive quill increases the vertical length of the complete assembly suspended from the top drive, and thus makes it necessary either to replace the bails with longer bails (which is expensive and time consuming) or to add extensions to the existing bails (which can be both faster and less expensive than replacing the bails) in order to provide necessary vertical clearance between the bottom of the CRT and the top of the suspended tubing string.

Bail extensions must be long enough to ensure that there will be clearance between the CRT and the casing joint carried by the elevator, but excessive clearance can lead to difficulties stabbing the CRT into the casing joint. The appropriate length for bail extensions will depend on multiple variable factors, including the position of the top drive "ears" relative to the top drive quill, and the lengths of:

- the bails;
- the CRT;
- any accessories such as a saver sub and crossover subs required to mate the CRT to the top drive quill; and
- additional equipment that may be mounted between the quill and CRT such as a torque-monitoring sub.

Because of these variables, there is no single bail extension length that will be practically suitable in all operational circumstances. Common prior art bail extensions hang freely from the bail eyes. Thus, the horizontal reach provided by the link tilts away from the well centerline toward the V-door is limited by the length of the bails. This reach is often insufficient to reach the joint at the V-door without manually moving the elevator and bail extensions to the joint, particularly on larger rigs. Longer bail extensions will improve the manual reach, but they further complicate stabbing the CRT into the casing joint as the distance between the top of the casing and the bottom of the CRT is increased.

BRIEF SUMMARY OF THE DISCLOSURE

The present disclosure teaches embodiments of a drilling rig bail extension system having bail extensions configured to freely pivot away from substantially collinear alignment with bails from which the bail extension system is suspended in a direction away from the well centerline toward the V-door of the drilling rig, while being constrained to remain substantially collinear with the bails when the bails are being deflected by the rig's link tilts. Optionally, the bail extensions may be length-adjustable.

In a first exemplary and non-limiting embodiment, a bail extension system in accordance with the present disclosure comprises two bail extension assemblies, each of which comprises:

a bail extension frame assembly (alternatively referred to as bail extension frame or simply "extension frame") mountable to the lower eye of a conventional bail; and a bail extension mountable to the extension frame.

Optionally, the bail extension system may include:

a frame extension yoke extending between and mountable to the two extension frames, and optionally width-adjustable; and one or more casing guides extending between and mountable to the two bail extensions.

In this first exemplary embodiment, each bail extension frame assembly comprises:

two vertical side members (or simply "side plates") spaced laterally apart to receive the lower eye of a bail;

a bail reaction member (or simply "bail reaction plate") extending between and connected to the upper ends of the side members;

frame assembly mounting means, for pivotably mounting the extension frame to the lower eye of a bail; and a bail extension mounting assembly, comprising a bail extension support member spanning between and connected to the two side members, and a bail extension suspension member supported by and extending below the bail extension support member, and having a lower end configured for engagement with the upper end of a bail extension (such as, for example, by means of a coaxial threaded connection).

The ends of the bail extension support member are mounted to the side members in a manner that substantially prevents the bail extension support member from swiveling about a horizontal axis transverse to the side plates. The bail extension suspension member is mounted to the bail extension support member in a manner that will substantially prevent swiveling of the bail extension suspension member in any direction relative to the bail extension support member. Accordingly, the angular orientation of a bail extension, relative to the extension frame from which it is suspended, will remain substantially constant regardless of the spatial orientation of the extension frame.

In this first exemplary embodiment, each bail extension comprises:

a bail extension tube (or simply "extension tube") having an upper end mountable to a bail extension frame; and a bail extension adjustment member (alternatively referred to as an "extension adjustment rod") insertable into the lower end of the bail extension tube so as to be axially movable within the bore of the extension tube.

The bail extension tube may be provided as a single tubular member, or alternatively may be made up of two or more coaxially-connected bail extension members, with at least the lower of such two or more bail extension members being a tubular member for receiving the bail extension adjustment rod. The bail extension adjustment rod (which may be either a solid member or a tubular member) has a lower end configured for swiveling engagement with an elevator of a drilling rig. Each bail extension also comprises locking means for releasably locking the bail extension adjustment rod to the bail extension tube at any of several axial positions relative to the bail extension tube.

Each bail extension frame assembly is suspendable from a bail by the extension frame mounting means, which may be provided in any functionally effective form without departing from the scope of the present disclosure. By way of non-limiting example, the extension frame mounting means may be provided as a pivot pin having a first end that can be passed through an opening in a first one of the side plates of the extension frame, through the bail eye, and then into supporting engagement with the second side plate (such as by being extended into an opening in the second side plate, or in any other functionally effective way). Such a pivot pin optionally may be provided in the form of a pivot pin assembly comprising two or more cooperative components.

The only constraint with respect to the form in which the frame assembly mounting means may be provided is that it must not in itself restrict or impeded pivoting of the bail extensions, relative to their associated extension frames, to an operationally significant degree, because it is intended for the bail extensions to be free to pivot out of collinear alignment with their associated bails in a direction away from the well centerline and toward the drilling rig's V-door. However, when the bails are urged to pivot in that same direction by activation of the drilling rig's link tilts, the bail extensions mounted thereto will be constrained to remain in substantially collinear alignment with their associated bails, such that the horizontal reach provided by the bail extensions away from the well centerline will be limited by the total of the bail length plus the bail extension length.

This functionality is provided in accordance with the present disclosure by the reaction plate extending between the upper ends of the side members of each frame assembly. The reaction plate is formed with a bail rod pocket configured and oriented to receive the bail rod of the associated bail in substantially non-loading engagement when the bail is in a vertical orientation, but in compressive contact when the bail is urged to pivot away from the well centerline by the link tilts, and thus providing a reaction force preventing the frame assembly from rotating about a horizontal axis relative to the bail. Because the angular orientation of the bail extensions relative to their associated frame assemblies remains substantially constant, the bail extensions will remain substantially collinear with their associated bails as the link tilts urge the bails away from the well centerline, thus maximizing the lateral reach of the bail extensions away from the well centerline.

The side plates of the frame assemblies are configured such that an overloading bending moment induced in the side plates by activation of the link tilts and lifting an excessive load in the elevator will cause stable plastic deformation of the side plates that will be readily visible to the drilling rig operator. In an alternative embodiment, the side plates may be shaped such that the two bail extensions will be offset from and not colinear with their associated bails.

The optional extension yoke can be mounted to and between the two bail extensions, at a selected location along the length of the bail extensions, so as to restrict lateral separation of the two bail extensions, and to constrain rotation of each bail extension about its longitudinal axis. The extension yoke thus may be helpful to maintain the required clearance between the CRT and the bail extensions, and may be configured to allow the lateral separation between the bail extensions to change, or, in an alternative embodiment, may be configurated to enable selective adjustment of the lateral separation of the bail extensions. In another alternative embodiment, the extension yoke may also be configured to guide a casing joint during CRT stabbing operations. In all cases, the extension yoke will be positioned sufficiently far below the lower bail eyes and appropriately shaped to provide sufficient vertical clearance between the CRT and a casing joint carried by an elevator mounted to the bail extensions through the entire range of motion of the bail extension system.

The optional one or more casing guides will also interconnect the bail extensions and constrain a casing joint carried by the elevator from moving away from the well centerline while allowing the joint to slide vertically through each guide when stabbing the CRT into the joint. The lower ends of the bail extensions must be allowed to separate sufficiently to enable proper operation of the elevator. The appropriate quantity and placement of casing guides required in a given case will be influenced by the stabbing distance; a longer stabbing distance may necessitate additional casing guides.

Various alternative embodiments of bail extension systems are contemplated within the scope of the present disclosure, including (but not limited to) embodiments in which:

- the functions of the extension yoke and casing guide are combined in a single apparatus or assembly;
- the extension assembly comprises one or more extension tubes of selected fixed length or lengths, such that the length of the bail extension can be adjusted by changing, adding, or removing extension tubes;
- at least one of the bail extensions comprises a one-piece tubular member or a one-piece non-tubular member;
- each bail extension is length-adjustable and comprises a bail extension tube and a bail adjustment member that is telescopically movable within an extension tube bore extending into the lower end of the bail extension tube, wherein the bail extension may comprise one or more secondary extension members coaxially-connected to the upper end of the extension tube, and wherein one or more of the one or more secondary extension members may be a tubular member and/or one or more of the one or more secondary extension members may be solid bar; and
- mass can be added to the bail extensions at one or more locations (such as on the adjustment rods or on the extension tubes) to slow rotation of the bail extension system about the lower bail eye (like a swinging compound pendulum), wherein the added mass may be provided, by way on non-limiting example, in the form of added material on existing parts or additional parts.

BRIEF DESCRIPTION OF THE DRAWINGS

Embodiments in accordance with the present disclosure will now be described with reference to the accompanying Figures, in which numerical references denote like parts, and in which.

DETAILED DESCRIPTION

Drilling Rig Environment

Figure 1A:
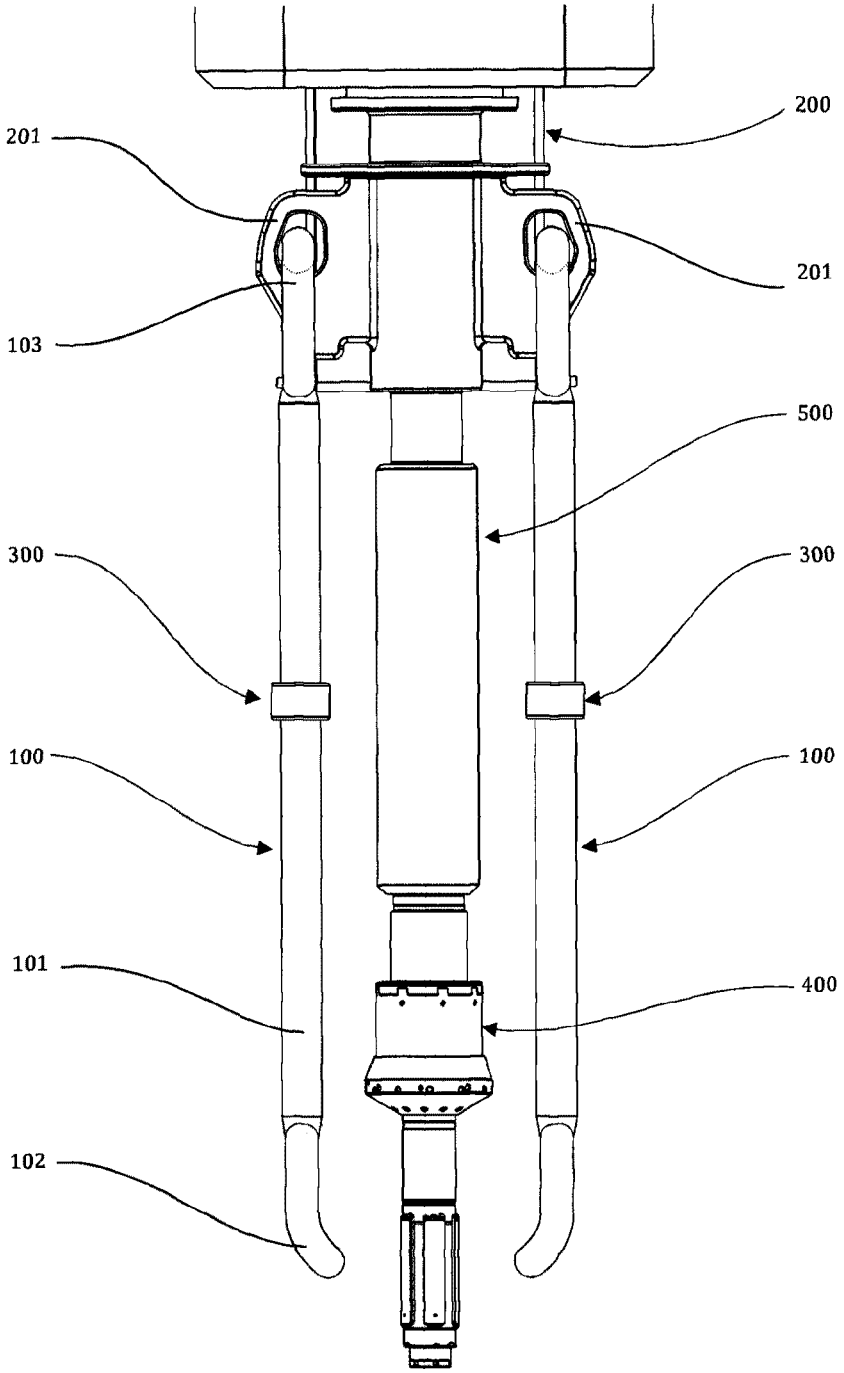
Figure 1A (prior art)
FIG. 1A is a front view of an exemplary prior art top drive system mounted on a drilling rig with fixed-length bails, link tilts, and a CRT installed, as viewed from the rig's V-door toward the well centerline.

FIG. 1A is a front view of an exemplary prior art top drive system 200 equipped with a pair of bails 100, a pair of link tilts 300, and a casing running tool (CRT 400). Each bail 100 comprises a bail rod 101, a lower loop 102 (alternatively referred to as lower eye 102), and an upper loop 103 (alternatively referred to as upper eye 103). Each bail 100 is suspended by its upper loop 103 from a mounting "ear" 201 on top drive system 200. As generally denoted by reference number 500, one or more accessory components (such as, for example, a saver sub), may be mounted between top drive 200 and CRT 400, and this can result in CRT 400 extending below bails 100.

Figure 1B:
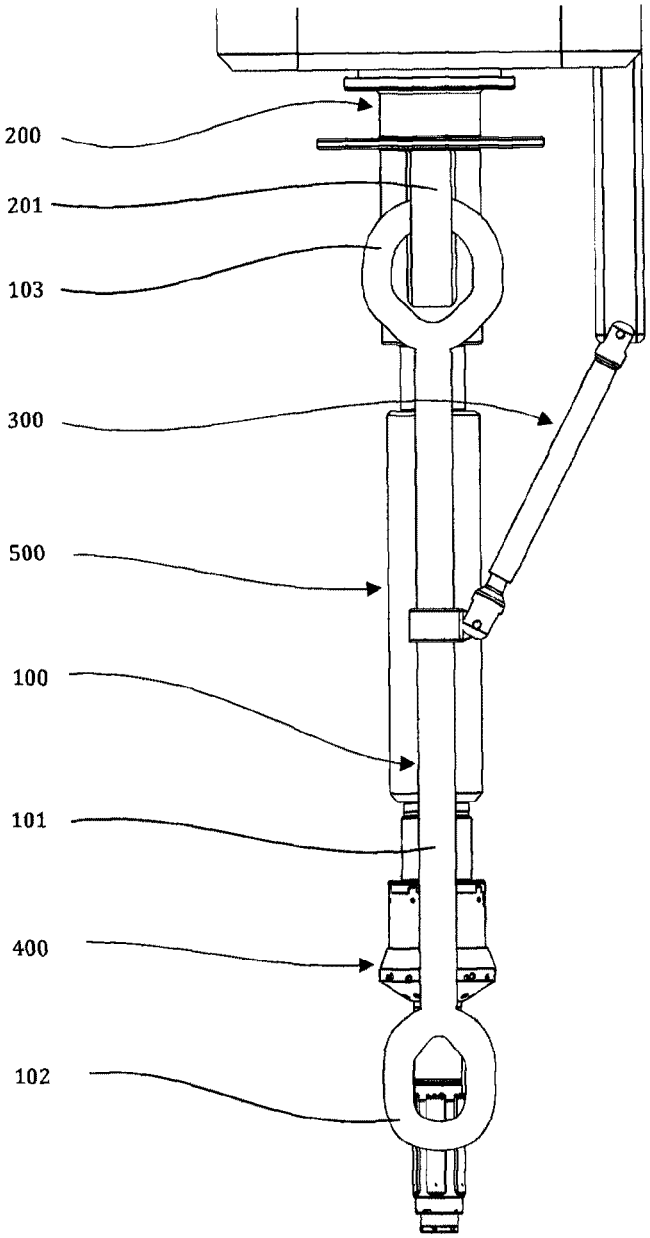
Figure 1B (prior art)
FIG. 1B is a side view of the prior art top drive system in FIG. 1A, with the bails in a vertical orientation.
Figure 2A:
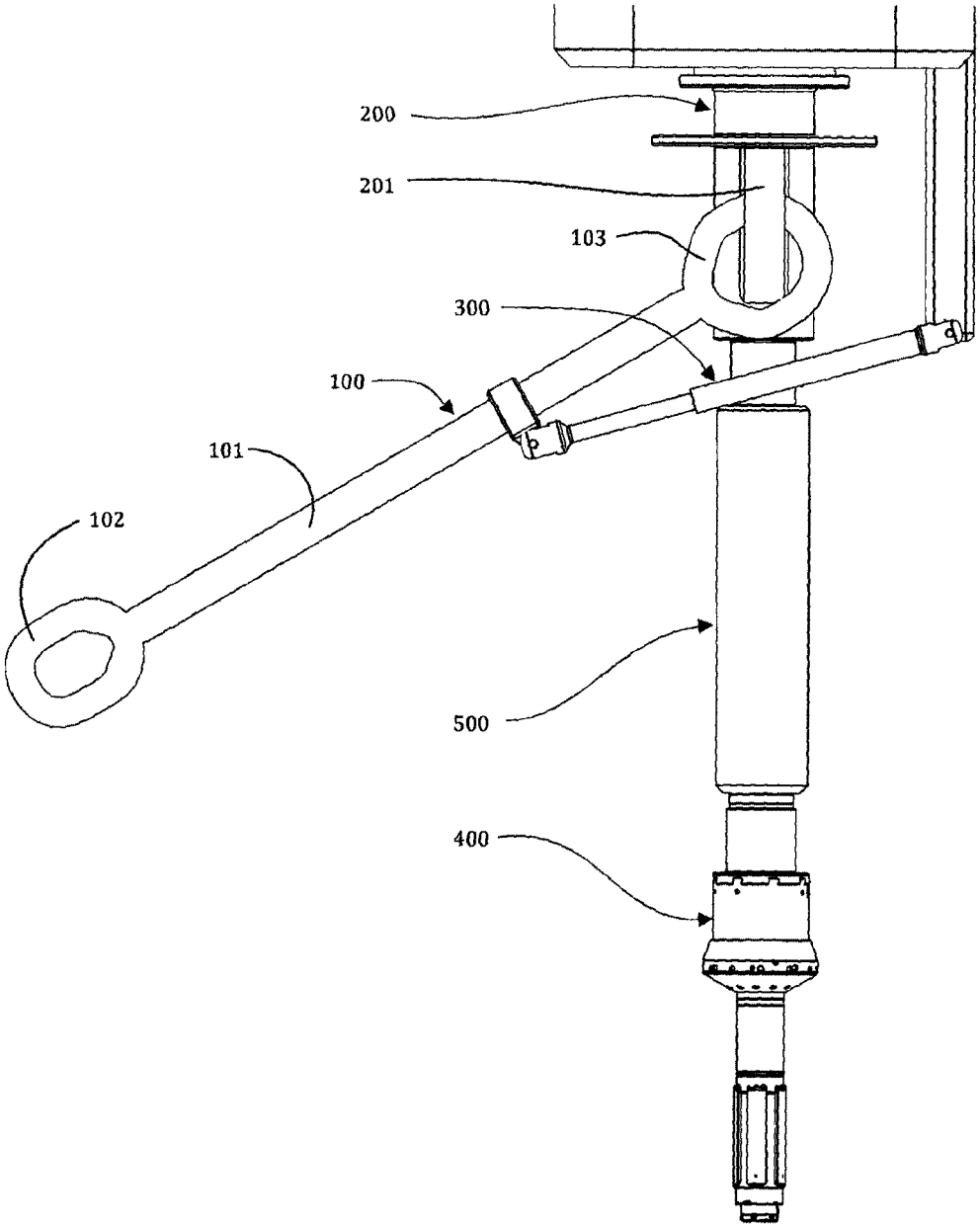
Figure 2A (prior art)
FIG. 2A is a side view of the prior art top drive system in FIGS. 1A and 1B, with the bails having been rotated to an inclined orientation by the link tilts.
Figure 2B:
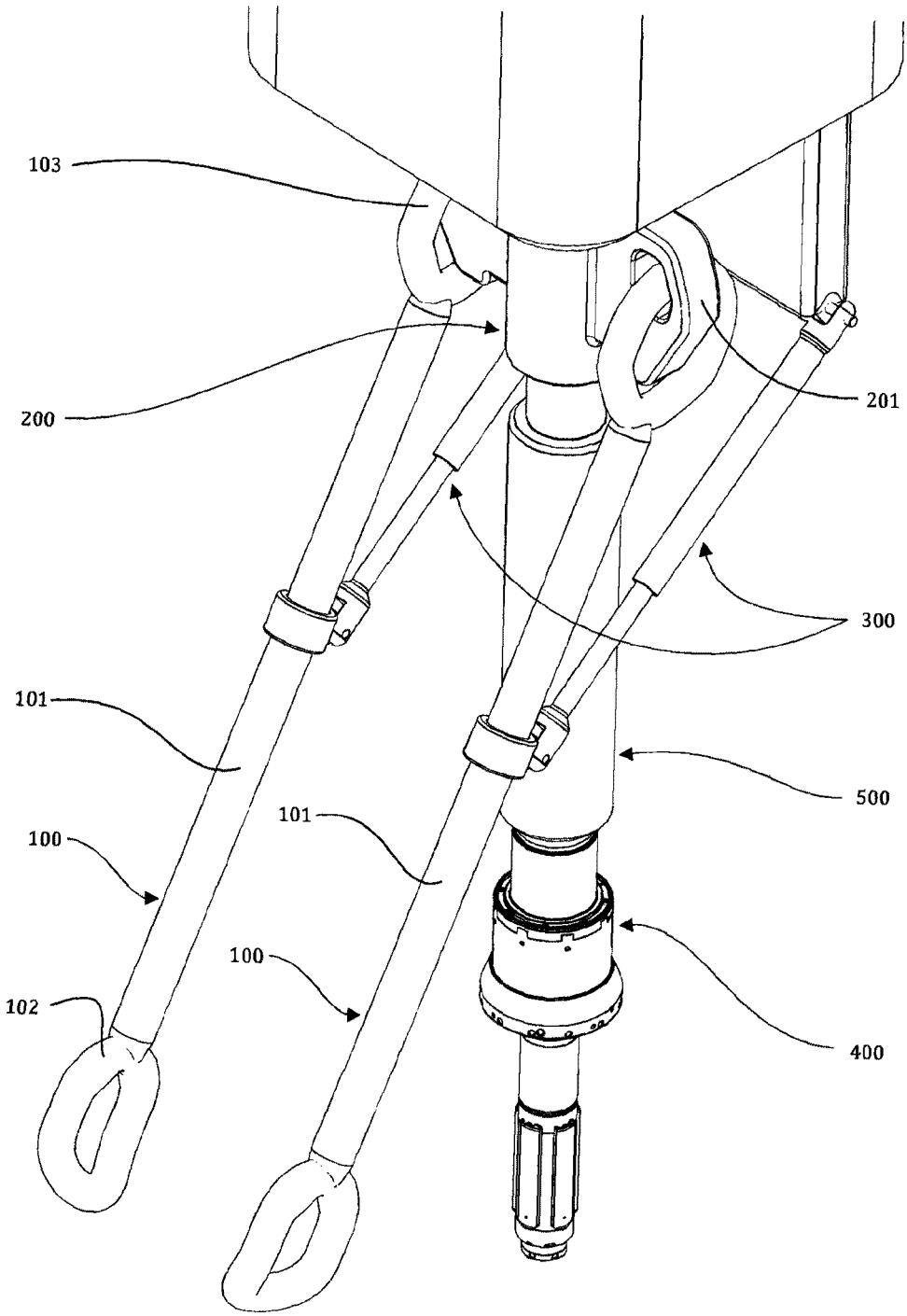
Figure 2B (prior art)
FIG. 2B is an isometric view of the prior art top drive system in FIGS. 1A and 1B, with the bails having been rotated to an inclined orientation as in FIG. 2A.

FIG. 1B is a side view of top drive system 200 with bails 100 shown in a vertical orientation. FIG. 2A is a side view, and FIG. 2B is an isometric view, of top drive system 200 with bails 100 shown moved to an inclined orientation by link tilts 300 toward the drilling rig's V-door (not shown).

Prior Art Bail Extension System

Figure 3:
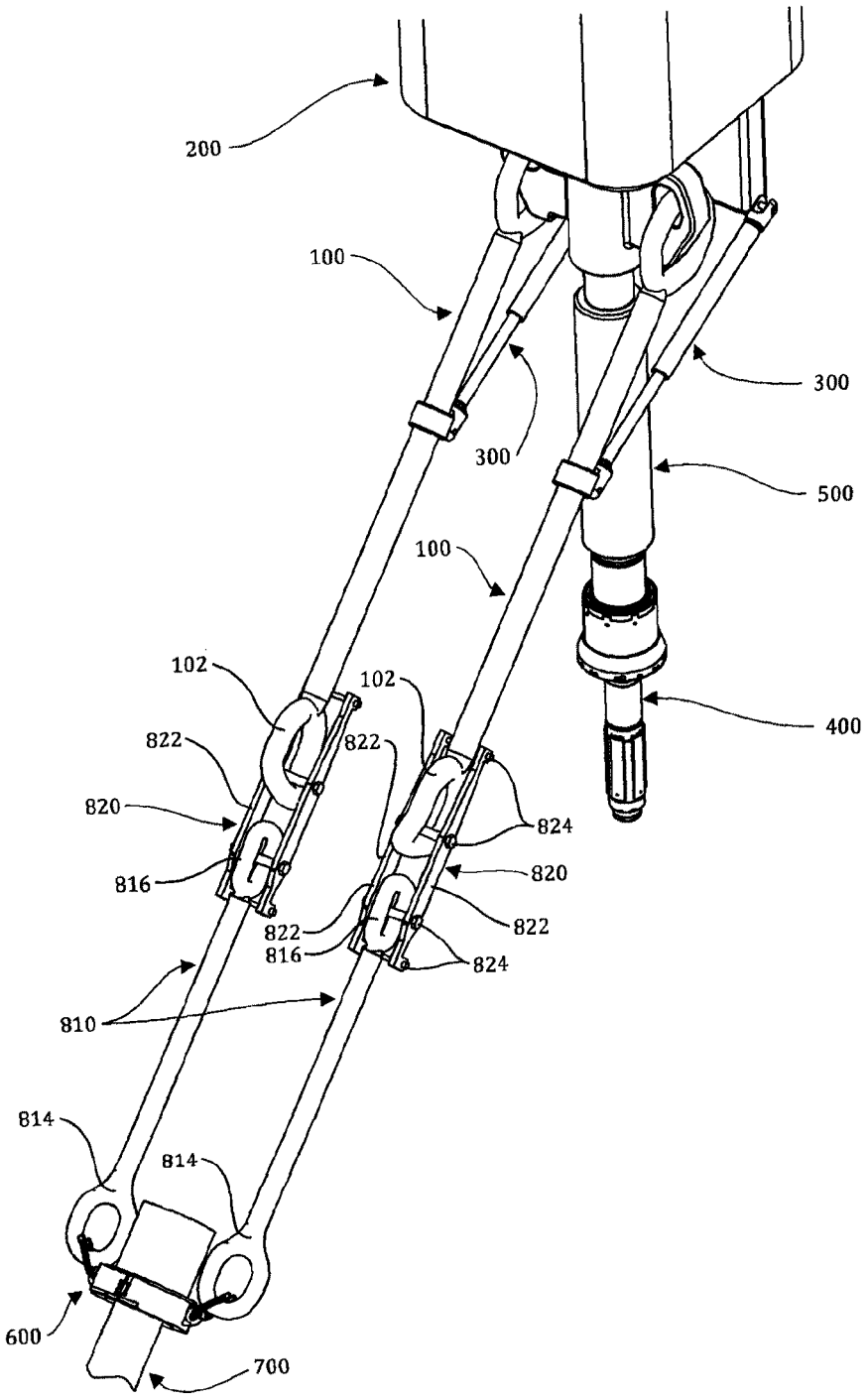
Figure 3 (prior art)
FIG. 3 is an isometric view of a prior art bail extension system mounted to the bails of a drilling rig, as seen when the bails have been pivoted in a direction away from the well centerline by the drilling rig's link tilts, with a pipe elevator mounted to the bail extensions and engaging a casing joint.

FIG. 3 illustrates a top-drive-equipped drilling rig generally as described above and illustrated in FIGS. 1A, 1B, 2A, and 2B, with one example of a prior art bail extension system mounted to lower eyes 102 of bails 100. This prior art system (which may be viewed in operation at https://www.linkedin.com/feed/update/urn:li:activity:6904383393270685696/) has a pair of bail extensions 810 generally similar to bails 100, but with axially-elongate upper eyes 816, along with conventional lower eyes 814 similar to lower eyes 102 of bails 100. Each upper eye 816 is mounted to the lower eye 102 of one of the bails 100 by means of an extension bracket 820 made up of two elongate side plates 822 separated by four connecting bolts 824 so as to allow both lower eye 102 of bail 100 and upper eye 816 of bail extension 810 to fit between side plates 822.

As shown in FIG. 3, lower bail eye 102 and upper bail extension eye 816 are mounted to extension bracket such that the uppermost of the four connecting bolts 824 passes under bail 100 above lower bail eye 102, the next lower bolt 824 passes through lower bail eye 102, the next lower bolt 824 passes through upper bail extension eye 816, and the lowermost bolt 824 passes under bail extension 810 below upper bail extension eye 816. When links 100 are tilted by link tilts 300 on top drive 200, as seen in FIG. 3, bail extensions 810 (shown with lower bail extension eyes 814 carrying a pipe elevator 600 engaging a casing joint 700) will remain in stable collinear relationship with bails 100, when in the illustrated configuration due to the rigidity that extension brackets 820 provide to the connection between bails 100 and bail extensions 810.

System Overview

Figure 4:
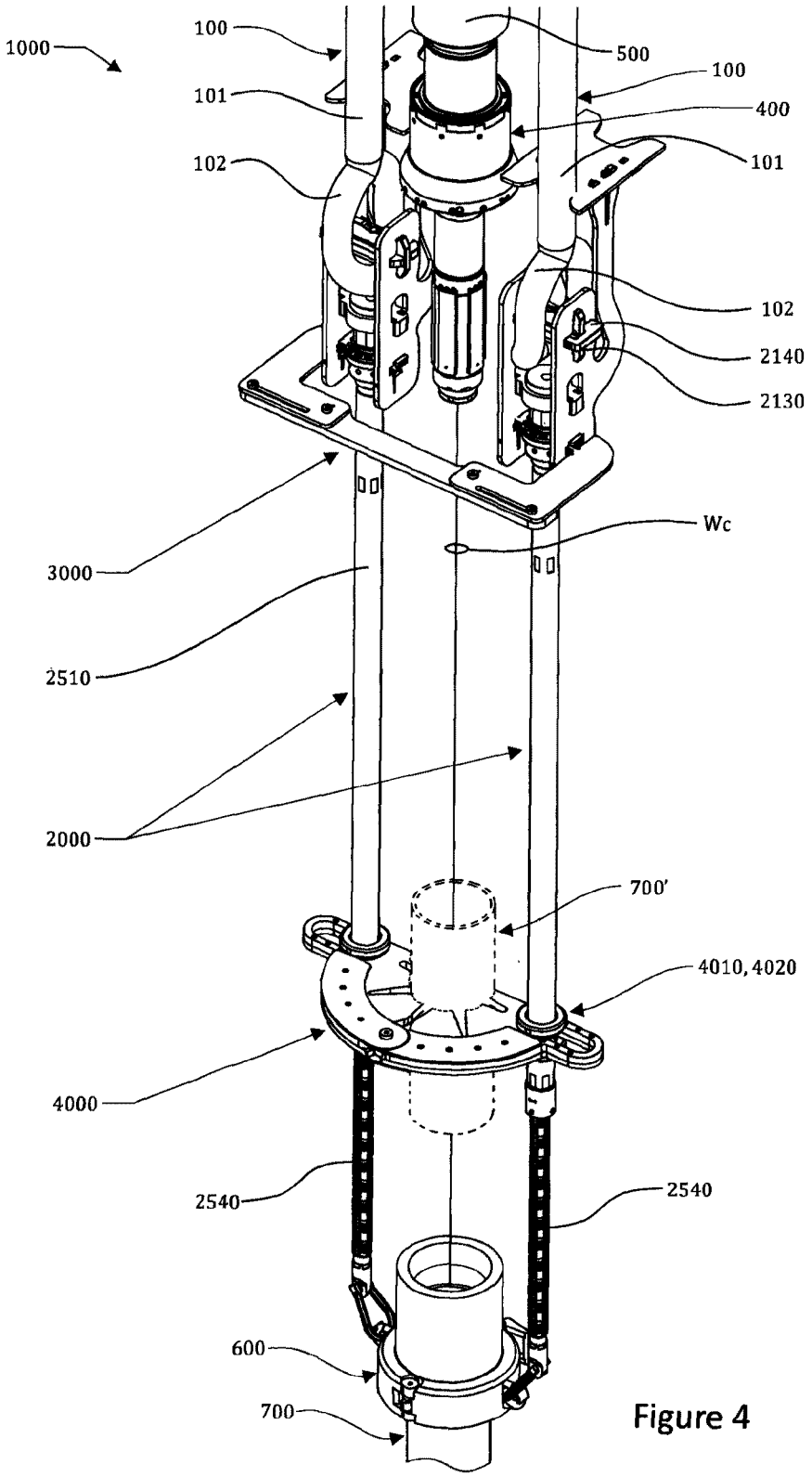
FIG. 4 is a not-to-scale isometric view of a non-limiting embodiment of a bail extension system in accordance with the present disclosure, shown suspended from the bails of a top drive system as in FIG. 1, and also shown with an optional extension yoke mounted to and between the bail extension frame assemblies, and with an option casing guide mounted to and between the two length-adjustable bail extensions.
Figure 5:
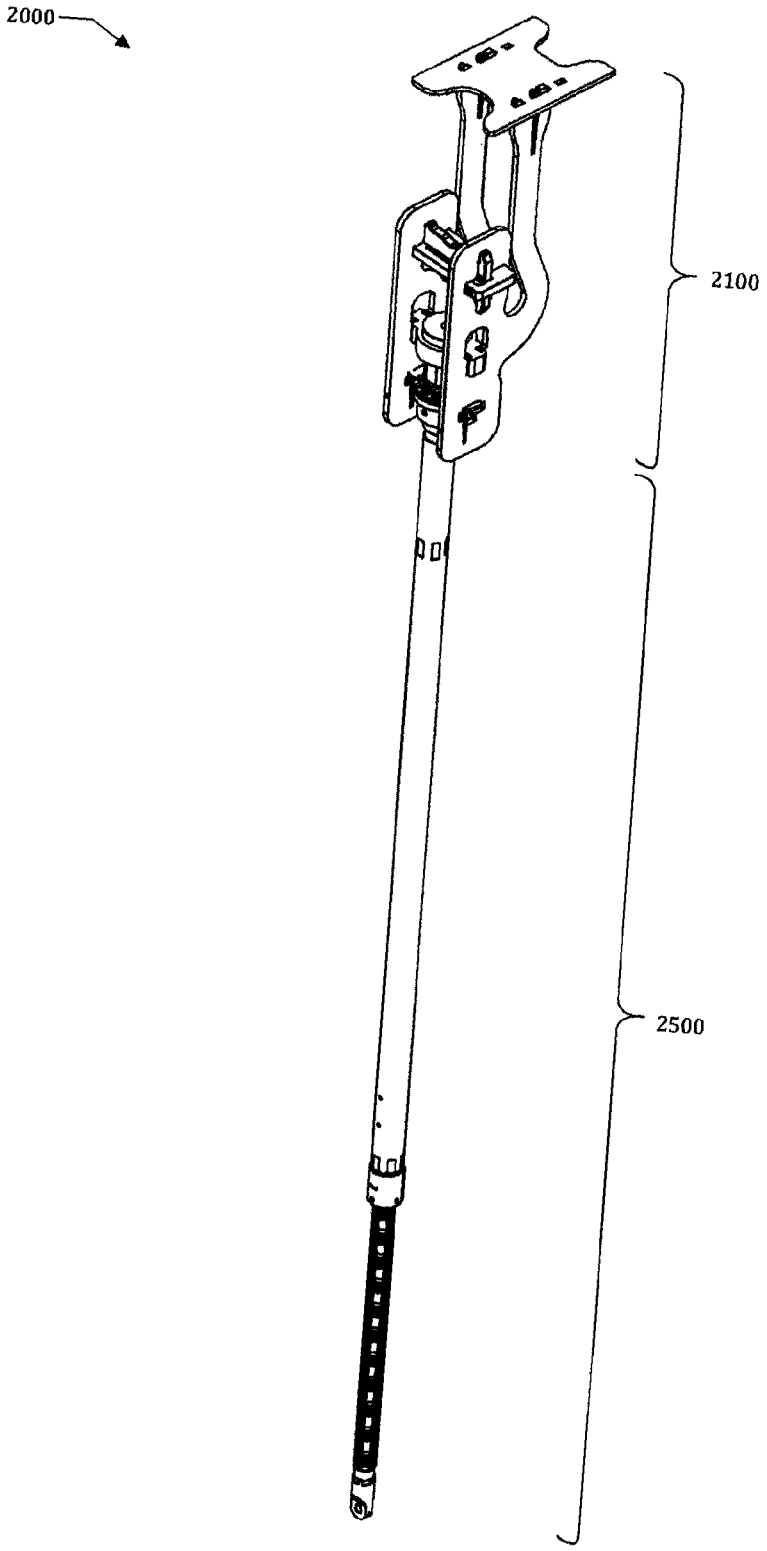
FIG. 5 is an isometric view of a length-adjustable bail extension as in FIG. 4, mounted to a bail extension frame assembly as in FIG. 4.

FIG. 4 is an isometric view of a first embodiment 1000 of a bail extension system in accordance with the present disclosure connected to a pair of bails 100. Bail extension system 1000 comprises a pair of bail extension assemblies 2000, and optionally may include an extension yoke 3000, and/or one or more casing guides 4000. As shown in FIG. 5, each bail extension assembly 2000 comprises a bail extension frame assembly or simply "extension frame") 2100 and a bail extension 2500 mounted to extension frame 2100, with bail extension 2500 having an upper end 2500U and a lower end 2500L. FIG. 4 illustrates a pipe elevator 600 mounted to bail extension assemblies and carrying a casing joint 700. Also, FIG. 4 schematically illustrates, in broken outline indicated by reference number 700', how a casing joint would appear disposed within and passing through casing guide 4000.

Frame Assembly

Figure 6:
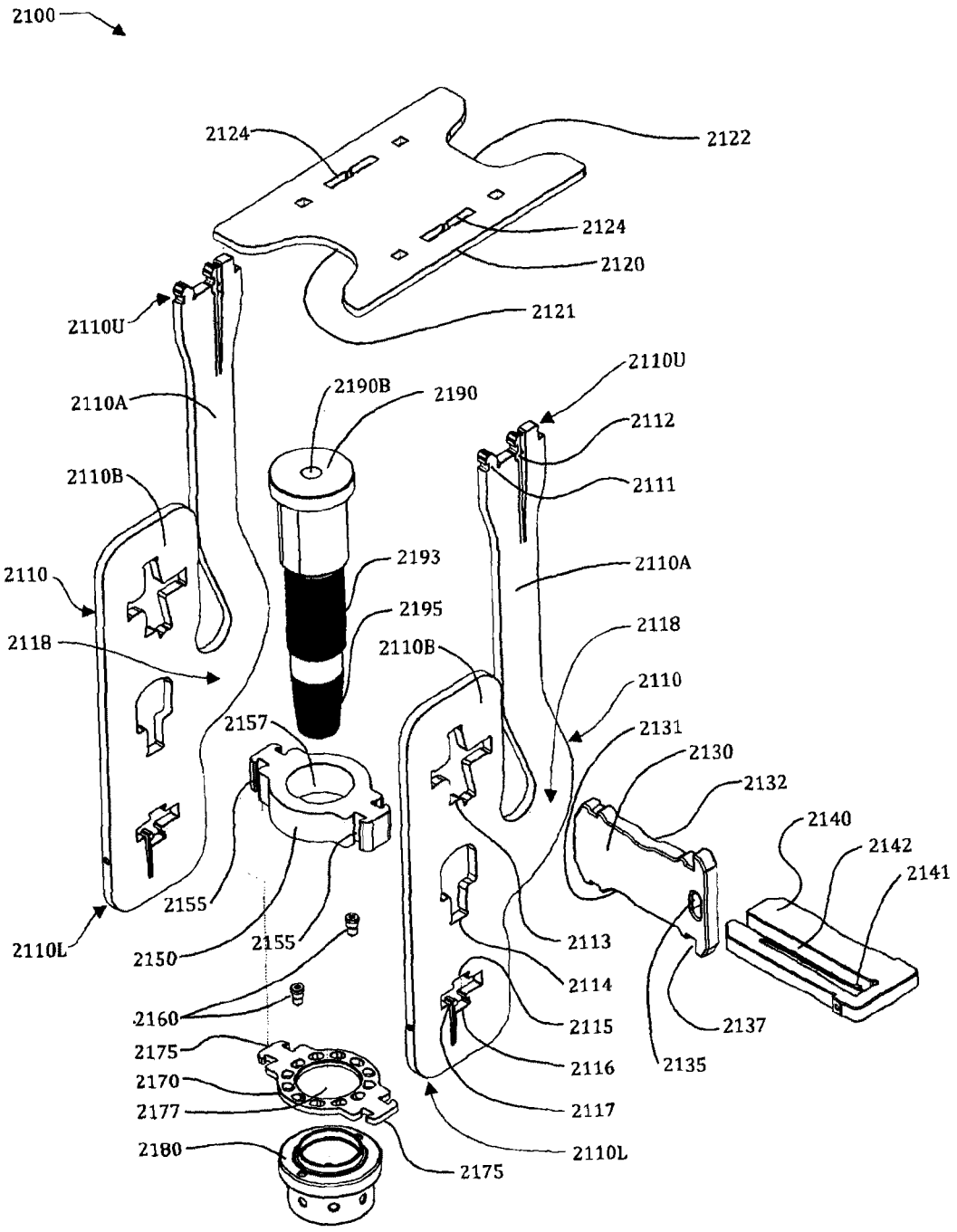
FIG. 6 is an exploded isometric view of a bail extension frame assembly as in FIG. 5.

FIG. 6 is an exploded isometric view of extension frame 2100, which in the illustrated embodiment comprises:

- two side plates 2110, each having an upper end 2110U and a lower end 2110L;
- a bail rod reaction plate (or simply "reaction plate") 2120;
- a vertical pin plate 2130 having a retention clip recess 2135;
- a horizontal pin plate 2140 having a slot 2142 configured to fit around vertical pin plate 2130 at right angles thereto, plus a resilient retention clip 2141 formed within slot 2142 and engageable with retention clip recess 2135 on vertical pin plate 2130;
- a bail extension support member (or simply "support member") 2150 configured for cooperative engagement with a bail extension support member (described below), and having T-shaped mounting lugs 2155 configured for engagement with mating support member windows 2114 in an intermediate interval of each side plate 2110;
- two tension plate lock bolts 2160;
- a tension plate 2170 having T-shaped mounting lugs 2175 configured for engagement with mating tension plate windows 2115 in a lower interval of each side plate 2110;
- a tension nut 2180; and
- a bail extension suspension member 2190, which in the illustrated embodiment is provided in the form of an "extension pin" having a threaded intermediate interval 2193 for threaded engagement with tension nut 2180, and a threaded lower interval 2195 for threaded engagement with upper end 2500U of a bail extension 2500.

Upper end 2110U of each side plate 2110 defines a reaction plate hook 2111 and a reaction plate clip 2112 which are engageable with reaction plate slots 2124 in reaction plate 2120, and thereby to connect reaction plate 2120 to upper ends 2110U of both side plates 2110. Side plates 2110 are interconnected at an appropriate horizontal spacing (dependent upon the configuration of the bail 100 to which it is to be mounted) using suitable pin means, which in the illustrated embodiment is a cross-sectionally cruciform pin assembled by:

- inserting vertical pin plate 2130 through the vertical portion of a cruciform pin plate window 2113 in a first one of the two side plates 2110, through lower bail eye 102, and similarly through a cruciform pin plate window 2113 in the second one of the side plates 2110, until an abutment 2137 on vertical pin plate 2130 contacts the first side plate 2110; and then
- inserting horizontal pin plate 2140 through the horizontal portion of pin plate window 2113 in the first side plate 2110 (with vertical pin plate 2130 engaging slot 2142 in horizontal pin plate 2140 in the process), through lower bail eye 102, and then through the horizontal portion of pin plate window 2113 in the section side plate 2110, until retention clip 2141 on horizontal pin plate 2140 engages retention clip recess 2135 on vertical pin plate 2130.

In the illustrated embodiment, vertical pin plate 2130 may be assembled into extension frame 2100 in a selected one of multiple alternative orientations. For that purpose, and as best seen in FIG. 6, vertical pin plate 2130 has lower and upper locating pockets 2131 and 2132 placed at different positions along the length of vertical pin plate 2130 to situate extension frame 2100 relative to lower bail eye 102 depending on whether lower bail eye 102 is offset (as shown in FIG. 1) or straight (not shown), respectively.

Extension pin 2190 acts as an interface for mounting bail extension 2500 to extension frame 2100. Extension pin 2190 passes through a pin opening 2157 in hoist plate 2150, through a pin opening 2177 in tension plate 2170 (which is fastened to tension nut 2180 using locking bolts 2160), and then into tension nut 2180 wherein threaded intermediate interval 2193 of extension pin 2190 engages the internal thread of tension nut 2180, thus securing hoist plate 2150 and tension plate 2170 to side plates 2110. The fastening of tension nut 2180 to tension nut 2180 by means of locking bolts 2160 prevents tension nut 2180 from backing off from extension pin 2190.

Reaction plate 2120 constrains rotation in one direction about the pin connection to lower bail eye 102, by reacting against bail rod 101 (as illustrated in FIG. 4). Reaction plate 2120 may be mountable to side plates 2110 in a selected one of multiple orientations, and has an offset bail pocket 2121 and a straight bail pocket 2122 to accommodate either bails with an offset lower eye 102 (as shown in FIG. 1) or bails with a straight lower eye (not shown), respectively. Reaction plate 2120 is illustrated herein as being reversible, but this is by way of non-limiting example only, as reaction plate 2120 could be provided in other forms or configurations without departing from the scope of the present disclosure.

Optionally, and as shown in the illustrated embodiment, side plates 2110 may be designed and configured to incorporate plastic hinge intervals 2118 in which initial yielding and plastic deformation of side plates 2110 will occur in the event of an excessive bending moment being applied to extension frame 2100, resulting from excessive loads being applied to bail extensions 2500. Preferably, side plates 2110 will be designed for a selected maximum overloading moment that will result in structurally stable yielding and plastic deformation that will provide a readily visible indication of system overload.

Extension Assembly

Figure 7:
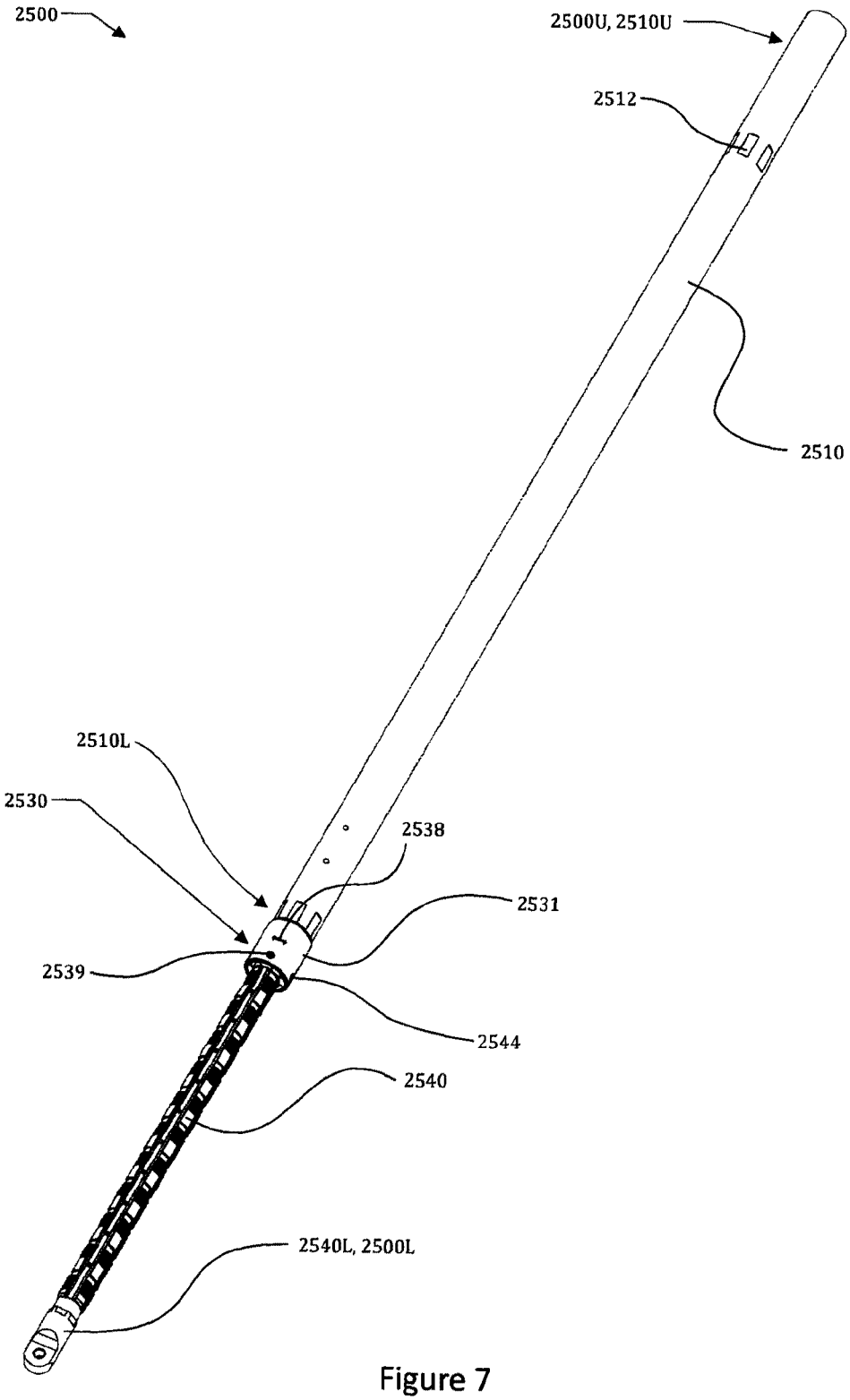
FIG. 7 is an isometric view of a length-adjustable bail extension as in FIG. 5.

Bail extension 2500 shown in FIG. 7 comprises:

an extension tube 2510 having an upper end 2510U (also corresponding to upper end 2500U of bail extension 2500), a lower end 2510L, an extension tube bore 2510B extending from lower end 2510L for at least part of the length of extension tube 2510, and (optionally) wrench flats 2512 at selected axial locations (to facilitate connection to related components);

a lock coupling assembly 2530 comprising a cylindrical lock coupling 2532 and a lock coupling cover 2531 which is removably securable to lock coupling 2532 by any suitable means (such as, for example, one or more lock coupling cover fasteners 2544 as shown in FIG. 7); and an adjustment rod 2540 having an upper end 2540U and a lower end 2540L and, in the illustrated embodiment, an adjustment rod bore 2540B.

Extension pin 2190 connects to upper end 2510U of extension tube 2510 via a threaded connection. In the illustrated embodiment, extension pins 2190, extension tubes 2510, and adjustment rods 2540 have respective bores 2190B, 2510B, and 2540B to allow for the optional passage of pneumatic or hydraulic lines. Such lines may enter the top of the extension pins 2190 and exit though a hole near the bottom of the adjustment rods 2540.

Length Adjustment

Figure 8:
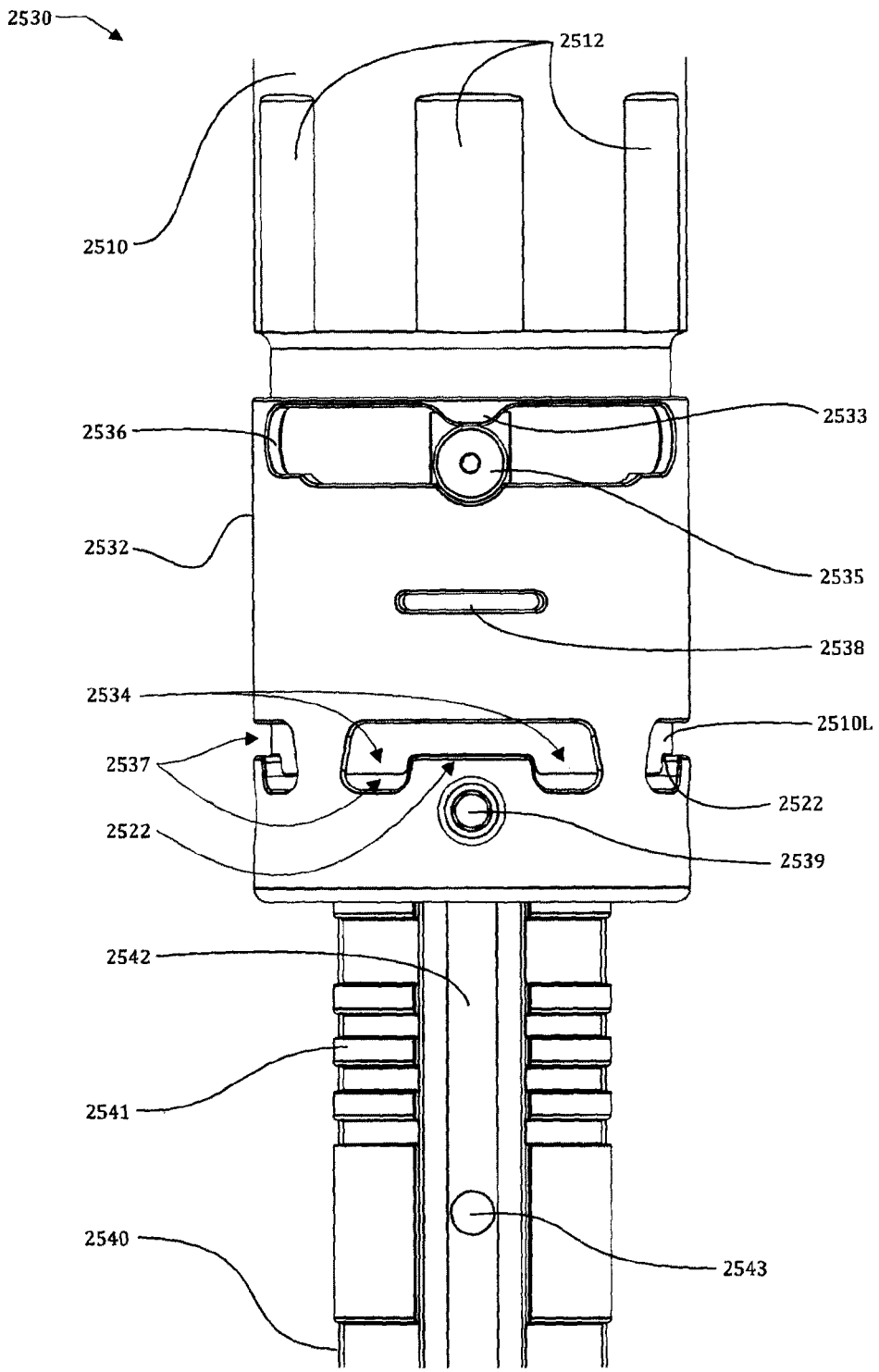
FIG. 8 is an enlarged view of an exemplary lock coupling assembly for a length-adjustable bail extension as in FIG. 7, shown with the lock coupling cover removed.
Figure 9:
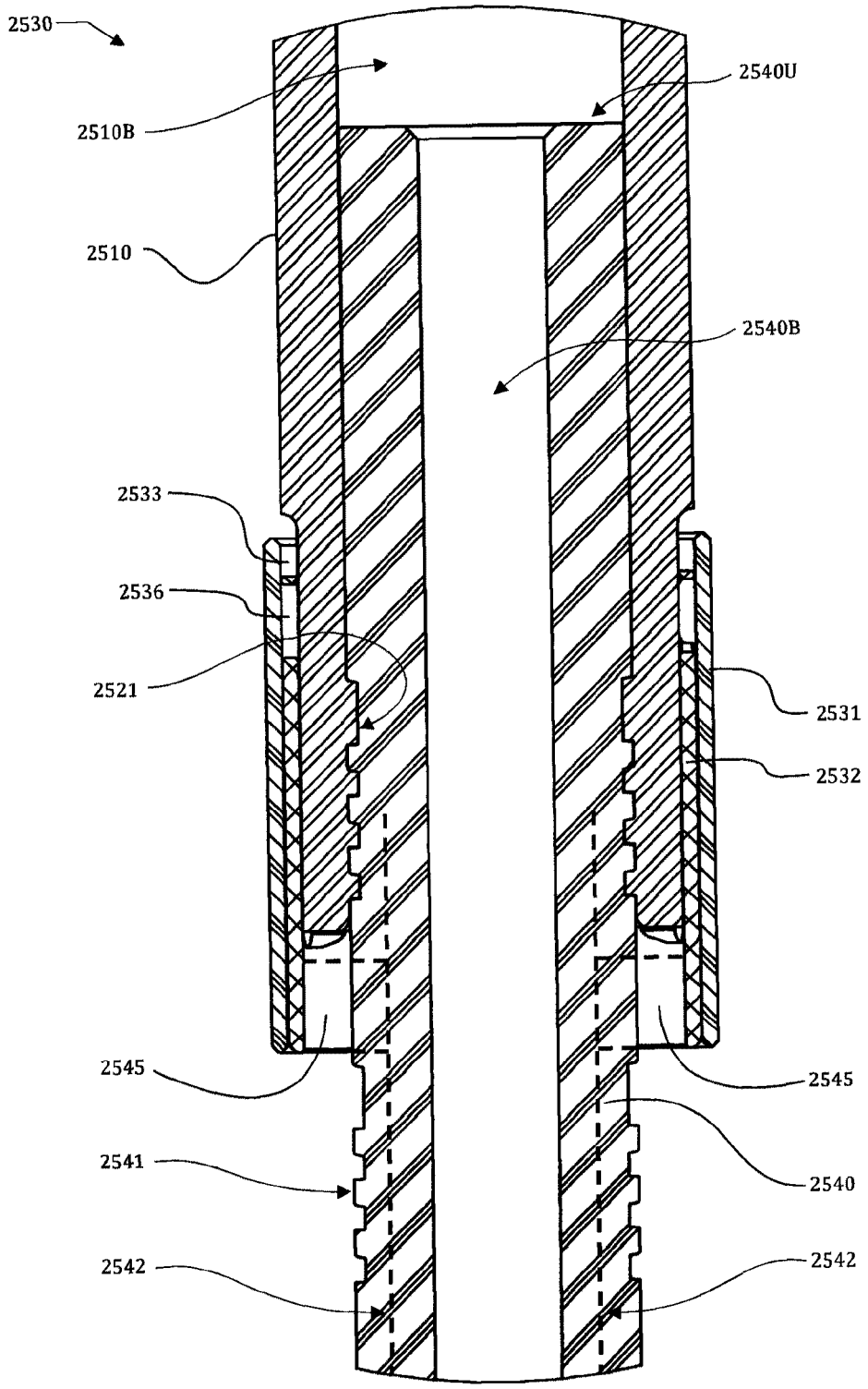
FIG. 9 is a longitudinal section through the lock coupling assembly on a plane rotated 45° around the axis of the extension assembly from the view in FIG. 8.

FIG. 8 is an enlarged view of a lock coupling assembly 2530 with the associated lock coupling cover 2531 not shown for clarity. FIG. 9 is a longitudinal section through lock coupling assembly 2530 (with lock coupling cover 2531 in place) on a plane rotated 45° around the axis of bail extension 2500 from the view shown in FIG. 8. Adjustment rod 2540 is telescopically movable within extension tube bore 2510B. Lock coupling assembly 2530 includes a generally cylindrical lock coupling 2532 which can be used to increase or decrease the length that adjustment rod 2540 protrudes from extension tube 2510 and thereby to adjust the overall length of bail extension 2500. Extension tube bore 2510B defines an inner breech-lock profile 2521 (shown in FIG. 9) that is selectively engageable with an outer breech-lock profile 2541 on the exterior surface of adjustment rod 2540 (also shown in FIG. 8) comprising a plurality of axially-spaced profile segments that define a plurality of selectable axial positions at which extension tube 2510 can be releasably locked to adjustment rod 2540.

In the illustrated embodiment, and as best understood from FIG. 8, outer breech-lock profile 2541 is formed on adjustment rod 2540 in four circumferentially discontinuous and equally spaced segments, with a keyway 2542 extending longitudinally between outer breech-lock profile segments. A plurality of adjustment rod locking pin sockets 2543, extending radially inward into adjustment rod 2540, are provided within keyway 2542 at axial spacings matching the axial spacings of the axially-spaced profile segments of breech-lock profile 2541 on adjustment rod 2540.

Lock coupling 2532 is coaxially disposed around and carried by extension tube 2510, while also being rotatable relative to extension tube 2510 with an angular range restricted by a follower lug 2535 mounted to extension tube 2510 and projecting radially outward therefrom into a circumferentially elongate follower lug window 2536 in lock coupling 2532, with follower lug 2535 being circumferentially movable within follower lug window 2536, all as may be seen in FIG. 8. Lock coupling 2532 also is axially movable relative to extension tube 2510 within a restricted range of movement defined by the configuration of follower lug window 2536 and a spring tab 2532 mounted therein, also as may be seen in FIG. 8.

As illustrated in FIG. 9, four equally circumferentially spaced adjustment rod engagement keys 2545 project radially inward from a lower region on lock coupling 2532, with each adjustment rod engagement key 2545 extending into one of the keyways 2542 on adjustment rod 2540, such that lock coupling 2532 is rotationally coupled to adjustment rod 2540 but also axially movable relative to adjustment rod 2540 except when axially restrained by at least one or more adjustment rod locking pin 2539 passing through an adjustment rod engagement key 2545 and into a selected adjustment rod locking pin socket 2543 in adjustment rod 2540.

FIG. 8 shows lock coupling 2532 in a "locked position", in which breech-lock profiles 2521 and 2541 are engaged. When locking pin 2539 is not engaged in a locking pin socket 2543, lock coupling 2532 may be pulled downward to disengage torque stops 2534 from torque reaction pockets 2522 located on the lower end of extension tube 2510. This causes the follower lug 2535 to deflect spring tab 2533, which resists accidental disengagement of the torque stops 2534 and torque reaction pockets 2522. Lock coupling 2532 and adjustment rod 2540 may then be rotated relative to extension tube 2510 to disengage breech-lock profiles 2521 and 2541. When breech-lock profiles 2521 and 2541 are disengaged, adjustment rod 2540 may be extended or retracted to an alternate position. When lock coupling 2532 is rotated back to the locked position, adjustment rod 2540 also rotates to re-engage breech-lock profiles 2521 and 2541. Locking pin 2539 may then be re-engaged in a locking pin socket 2543.

As shown in FIG. 8, a circumferentially elongate index window 2538 optionally may be provided in lock coupling 2532 to facilitate accurate rotational positioning of adjustment rod 2540 relative to extension tube 2510 when axially repositioning adjustment rod 2540 relative to extension tube 2510, and thereby facilitating reinstallation of locking pin 2539 into a selected locking pin socket 2543, by viewing an index mark or pattern of index marks provided on extension tube 2510 through index window 2538 and adjusting lock coupling 2532 as necessary to center the index marks within index window 2538.

Although lock coupling assembly 2530 has been illustrated and described in detail in the present disclosure, this is by way on non-limiting example only, and it is to be understood that alternative embodiments of bail extension systems having length-adjustable bail extensions may use any functionally suitable type of couplings or length-adjustment means without departing from the intended scope of the present disclosure.

Extension Yoke

Figure 10:
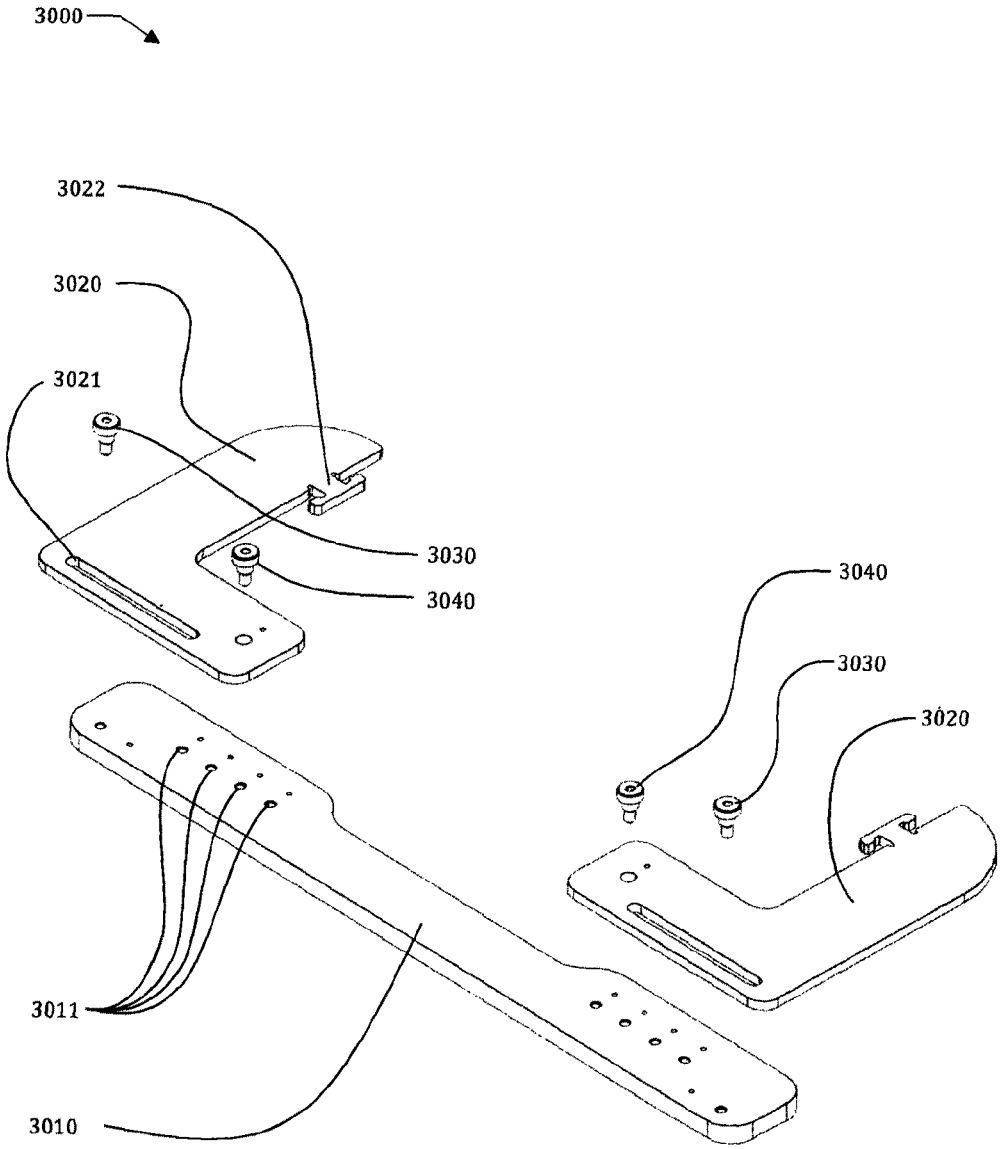
FIG. 10 is an exploded isometric view of an extension yoke as in FIG. 4.

During casing running operations using a CRT, the lateral separation between bails 100 and bail extensions 2500 may require adjustment to provide clearance for the CRT. Optional extension yoke 3000 attaches to side plates 2110 of bail extensions 2500 as shown in FIG. 4. FIG. 10 is an exploded isometric view of extension yoke 3000, which comprises two outer yoke plates 3020 and a center yoke plate 3010 that are assembled to allow the lateral separation between bail extensions 2500 to be selectively adjusted. A tab 3022 fits into a window 2116 in outer side plate 2110 and may be secured with a clip 2117 (shown in FIG. 6). Center yoke plate 3010 is connected to outer yoke plates 3020 via fasteners 3030 which run within slots 3021, and via fasteners

3040 which can be installed in one of several holes 3011 to select the desired lateral separation between bail extensions 2500.

Casing Guide

Figure 11:
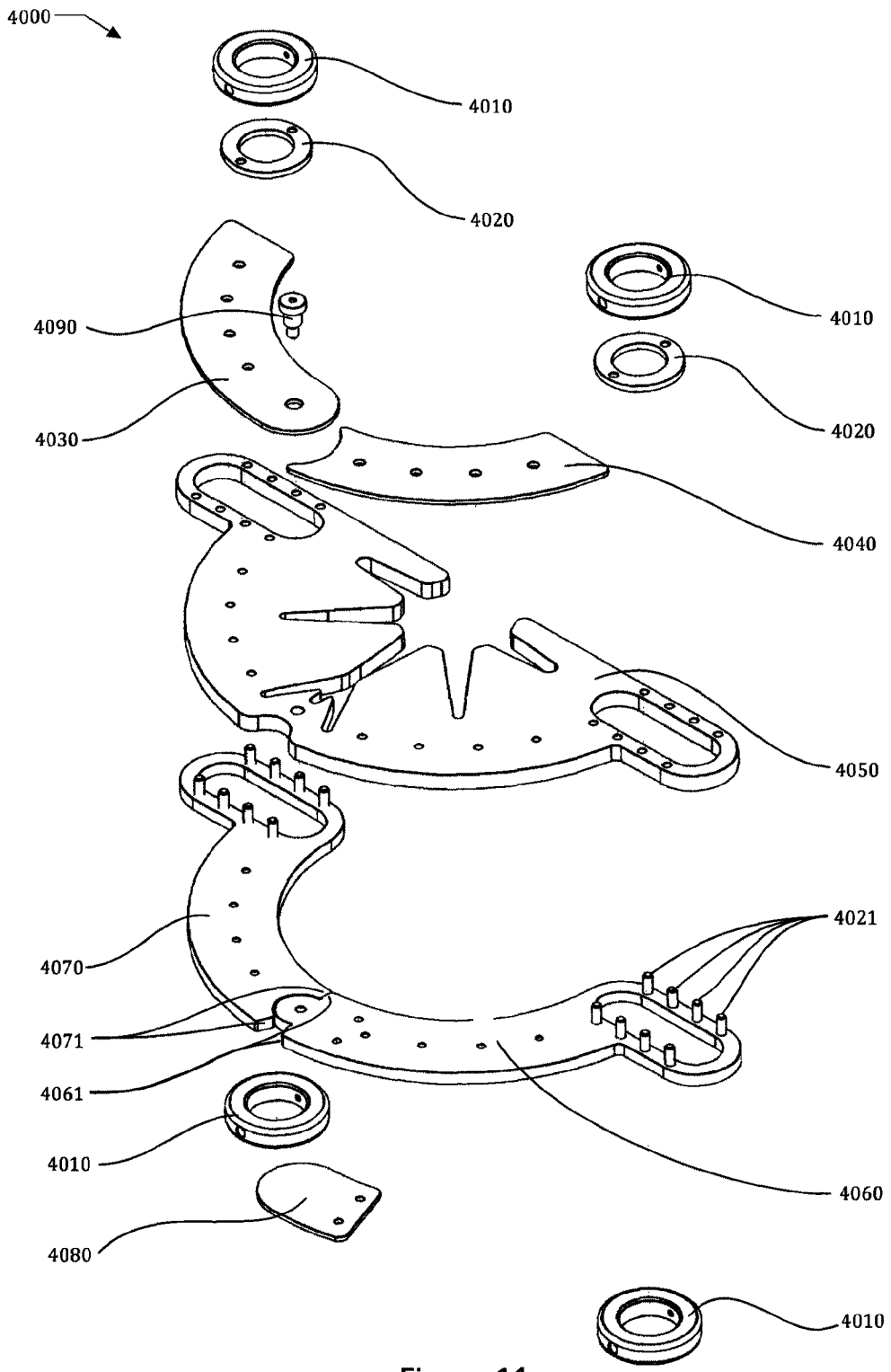
FIG. 11 is an exploded isometric view of a casing guide as in FIG. 4.

When running a casing string into a wellbore, the CRT must stab into each casing joint added to the string. If the casing is not sufficiently constrained, it can move off-axis with respect to the CRT, which makes the stabbing process difficult and reduces the efficiency of casing running operations. In the exemplary and non-limiting embodiment shown in FIG. 4, bail extension system 1000 has a single casing guide 4000 to guide the casing during stabbing. FIG. 11 is an exploded isometric view of casing guide 4000, which comprises a shaped elastomer 4050 fastened between clamping plates 4030 and 4040 above, and support plates 4060 and 4070 below, Clamping plate 4030 and support plate 4060 are connected by a pinned connection 4090. This hinge point allows controlled separation of bail extensions 2500 required for operation of pipe elevator 600. Support plates 4060 and 4070 are shaped to fit around extension tubes 2510 of bail extensions 2500 with slots to allow variation in the lateral separation between the two bail extensions 2500. Support plates 4060 and 4070 have pivot stops 4061 and 4071 to control the amount of pivoting permitted.

In this embodiment, locating and securing casing guide 4000 on extension tubes 2510 requires positioning span rings 4020 on selected span adjustment pins 4021 around the perimeter of the slots and securing collars 4010 above and below casing guide 4000. The selected position of span rings 4020 on span adjustment pins 4021 dictates the lateral separation between the bail extensions 2500. Fasteners secure collars extension tubes 2510 at a selected axial location. A pivot cap 4080 is installed underneath support plates 4060 and 4070 to reduce the risk of pinching. Additional casing guides 4000 may be placed along the length of extension tube 2510 and extension tube 2510. The quantity and location of casing guides 4000 may be selected based on operational considerations for the specific drilling rig using bail extension system 1000.

Operation

Figure 12:
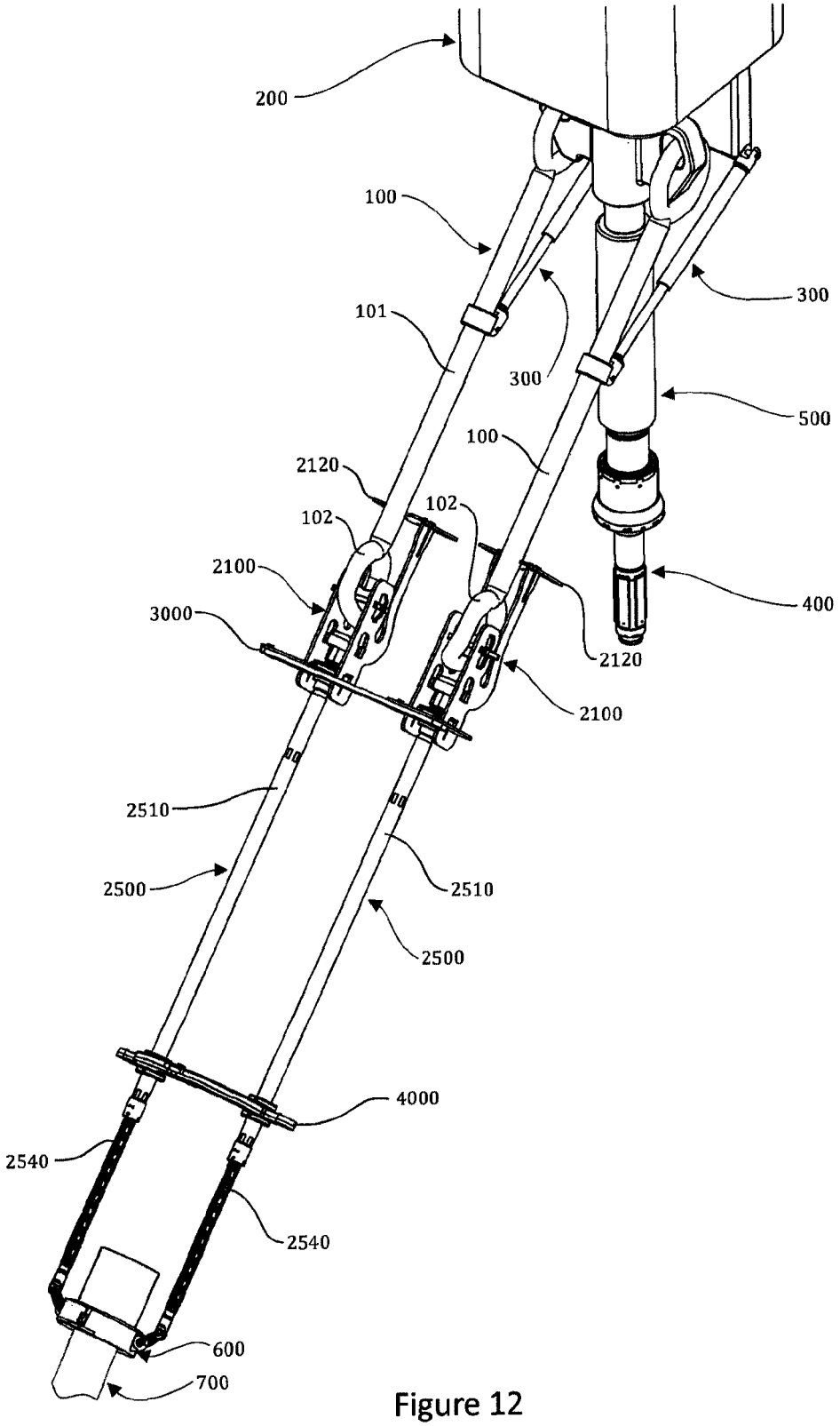
FIG. 12 is a not-to-scale isometric view of an embodiment of a bail extension system in accordance with the present disclosure mounted to the bails of a drilling rig, as seen when the bails have been pivoted in a direction away from the well centerline by the drilling rig's link tilts, with a pipe elevator mounted to the bail extensions and engaging a casing joint.

FIG. 12 illustrates an exemplary and non-limiting embodiment of a bail extension system 1000 in accordance with the present disclosure mounted on a top-drive-equipped drilling rig as in FIGS. 1A, 1B, 2A, and 2B. In this embodiment, the bail extension system 1000 incorporates two length-adjustable bail extensions 2500 (each comprising a bail extension 2510 and an extension rod 2540), two bail extension frames 2100 each mounted to a bail 100, an extension yoke 3000 mounted between bail extension frames 2100, and a casing guide 4000 mounted between bail extensions 2510. FIG. 12 illustrates the bail extension system 1000 as it would appear with the bails and bail extensions deflected by the link tilts 300 on top drive 200, and with extension rods 2540 carrying a pipe elevator 600 engaging a casing joint 700. Due to the rigidity that bail extension frames 2100 provide to the connection between bails 100 and bail extensions 2500, bail extensions 2500 will remain in stable collinear relationship with bails 100, when in the illustrated configuration.

ALTERNATIVE EMBODIMENTS

In other embodiments of bail extension systems in accordance with the present disclosure, the extension yoke and extension assemblies may have non-adjustable fixed lengths. Such embodiments may be less costly to manufacture while suitable for use on drilling rigs of constant configuration.

In further embodiments of bail extension systems in accordance with the present disclosure, the casing guide support plates may have a scalloped profile on the inside of the slotted holes through which the extension assemblies fit, making span adjustment pins 4021 unnecessary.

It will be readily appreciated by persons skilled in the art that various modifications to embodiments in accordance with the present disclosure may be devised without departing from the scope of the present teachings, including modifications that use equivalent structures or materials hereafter conceived or developed.

It is especially to be understood that the scope of the present disclosure is not intended to be limited to described or illustrated embodiments, and that the substitution of a variant of any claimed or illustrated element or feature, without any substantial resultant change in functionality, will not constitute a departure from the scope of the disclosure.

In this patent document, any form of the word "comprise" is to be understood in its non-limiting sense to mean that any element or feature following such word is included, but elements or features not specifically mentioned are not excluded. A reference to an element or feature by the indefinite article "a" does not exclude the possibility that more than one such element or feature is present, unless the context clearly requires that there be one and only one such element or feature.

Any use herein of any form of the terms "connect", "mount", "engage", "couple", "attach", or any other term describing an interaction between elements is not meant to limit the interaction to direct interaction between the subject elements, and may also include indirect interaction between the elements such as through secondary or intermediary structure.

Relational and conformational terms such as (but not limited to) "horizontal", "vertical", "parallel", "coaxial", and "collinear" are not intended to denote or require absolute mathematical or geometrical precision. Accordingly, such terms are to be understood as denoting or requiring substantial precision only (e.g., "substantially horizontal" or "substantially collinear") unless the context clearly requires otherwise.

Wherever used in this document, the terms "typical" and "typically" are to be understood and interpreted in the sense of being representative of common usage or practice, and are not intended to be understood or interpreted as implying essentiality or invariability.

LIST OF COMPONENTS AND FEATURES

| Feature Number | Description |
|---|---|
| 100 | Bail |
| 101 | Bail rod |
| 102 | Bail lower loop (lower eye) |
| 103 | Bail upper loop (upper eye) |
| 200 | Top drive |
| 201 | Mounting ear |
| 300 | Link tilt |
| 400 | Casing running tool (CRT) |
| 500 | Accessory components |
| 600 | Elevator |
| 700 | Casing joint |
| 700' | Casing joint (schematic representation) |
| 1000 | Bail extension system |
| 2000 | Bail extension assembly |
| 2100 | Bail extension frame assembly |

-continued

| Feature Number | Description |
|---|---|
| 2110 | Bail extension side plate |
| 2110A | Upper segment of side plate |
| 2110B | Lower segment of side plate |
| 2110U | Upper end of side plate |
| 2110L | Lower end of side plate |
| 2111 | Reaction plate hook |
| 2112 | Reaction plate clip |
| 2113 | Cruciform pin window |
| 2114 | Bail extension support member window |
| 2115 | Tension plate window |
| 2116 | Yoke window |
| 2117 | Yoke clip |
| 2118 | Plastic deformation interval |
| 2120 | Bail rod reaction plate |
| 2121 | Offset bail rod pocket |
| 2122 | Centered bail rod pocket |
| 2124 | Reaction plate slots |
| 2130 | Vertical pin plate |
| 2131 | Lower locating pocket (for bail with offset lower eye) |
| 2132 | Upper locating pocket (for bail with straight lower eye) |
| 2135 | Retention clip recess |
| 2137 | Abutment |
| 2140 | Horizontal pin plate |
| 2141 | Retention clip |
| 2142 | Slot (in 2140) |
| 2150 | Bail extension support member |
| 2155 | Mounting lugs (for 2150) |
| 2157 | Pin opening (in 2150) |
| 2160 | Tension lock lugs |
| 2170 | Tension plate |
| 2175 | Mounting lugs (for 2170) |
| 2177 | Pin opening (in 2170) |
| 2180 | Tension nut |
| 2190 | Bail extension suspension member ("extension pin") |
| 2190B | Extension pin bore |
| 2193 | Threaded intermediate interval (of 2190) |
| 2195 | Threaded lower interval (of 2190) |
| 2500U | Upper end of bail extension |
| 2500L | Lower end of bail extension |
| 2510 | Bail extension tube |
| 2510B | Bail extension bore |
| 2510U | Upper end of bail extension tube |
| 2510L | Lower end of bail extension tube |
| 2512 | Wrench flats |
| 2521 | Inner breech-lock profile (in 2510B) |
| 2522 | Torque reaction pockets (on 2510L) |
| 2530 | Lock coupling assembly |
| 2531 | Lock coupling cover |
| 2532 | Lock coupling |
| 2533 | Spring tab |
| 2534 | Torque stop (on 2532) |
| 2535 | Follower lug |
| 2536 | Follower lug window (on 2532) |
| 2537 | Torque stop window (on 2532) |
| 2538 | Index window (on 2532) |
| 2539 | Threaded adjustment rod locking pin |
| 2540 | Adjustment rod |
| 2540B | Adjustment rod bore |
| 2540U | Upper end of adjustment rod |
| 2540L | Lower end of adjustment rod |
| 2541 | Outer breech-lock profile (on 2540) |
| 2542 | Adjustment rod keyway (in 2540) |
| 2543 | Adjustment rod locking pin socket (in 2542) |
| 2544 | Lock coupling cover fastener |
| 2545 | Adjustment rod engagement key (on 2532) |
| 3000 | Extension yoke (upper linkage) |
| 3010 | Center linkage plate |
| 3011 | Span increments |
| 3020 | Outer linkage plate |
| 3021 | Running slot |
| 3022 | Attachment tabs |

-continued

| Feature Number | Description |
|---|---|
| 3030 | Slot lug |
| 3040 | Span lug |
| 4000 | Casing guide (lower linkage) |
| 4010 | Collar |
| 4020 | Span ring |
| 4021 | Span adjustment pins |
| 4030 | Clamping plate (male) |
| 4040 | Clamping plate (female) |
| 4050 | Elastomer guide |
| 4060 | Support plate (male) |
| 4061 | Pivot stop |
| 4070 | Support plate (female) |
| 4071 | Pivot stop |
| 4080 | Pivot cap |
| 4090 | Pivot pin |
| Wc | Well centerline |

What is claimed is:

1. A bail extension system for use on a drilling rig having a V-door and two bails, each bail comprising a bail rod extending between an upper eye and a lower eye, said bail extension system comprising:

(a) two bail extension frame assemblies, each mountable to the lower eye of an associated one of the bails; and (b) two bail extensions, each having an upper end mountable to an associated one of the bail extension frame assemblies;

wherein:

(c) each bail extension frame assembly comprises:

two vertical side members spaced apart to receive the lower eye of the associated bail, with each side member having an upper end and a lower end;

a bail rod reaction member extending between and connected to the upper ends of the vertical side members, said bail rod reaction member having a bail rod pocket configured to receive the bail rod of the associated bail;

frame assembly mounting means, for pivotably mounting the bail extension frame assembly to the lower eye of the associated bail; and a bail extension mounting assembly, comprising a bail extension support member extending between the two side members, and a bail extension suspension member supported by and extending below the bail extension support member, and having a lower end configured for engagement with the upper end of a bail extension; and (d) each bail extension comprises a bail extension member having an upper end rigidly mountable to the associated bail extension frame assembly, and a lower end mountable to a pipe elevator;

such that when the bails are urged to pivot away from the centerline of a well being drilled by the drilling rig and toward the V-door, each bail rod reaction member will provide a compressive reaction force against the associated bail rod received within the bail rod reaction pocket of the bail reaction member, thereby preventing rotation of the bail extension frame assemblies relative to the bails.

2. The bail extension system as in claim 1 wherein each vertical side member incorporates a plastic hinge interval.

3. The bail extension system as in claim 1 wherein at least one of the bail extensions comprises a one-piece tubular member or a one-piece non-tubular member.

4. The bail extension system as in claim 1 wherein each bail extension is length-adjustable and comprises a bail extension tube and a bail adjustment member that is telescopically movable within an extension tube bore extending into the lower end of the bail extension tube.

5. A bail extension system as in claim 4 wherein the bail extension comprises one or more secondary extension members coaxially-connected to the upper end of the extension tube.

6. The bail extension system as in claim 5 wherein one or more of the one or more secondary extension members is a tubular member.

7. The bail extension system as in claim 5 wherein one or more of the one or more secondary extension members is a solid bar.

8. The bail extension system as in claim 1, further comprising an extension yoke connected between the bail extension frame assemblies.

9. The bail extension system as in claim 1, further comprising one or more casing guides connected between the bail extensions.

* * * * *